United States Patent [19]

Hurko et al.

[11] 4,242,554

[45] Dec. 30, 1980

[54] EFFECTIVE TIME RATIO BROWNING IN A MICROWAVE OVEN EMPLOYING HIGH THERMAL MASS BROWNING UNIT

[75] Inventors: Bohdan Hurko; Thomas R. Payne, both of Louisville, Ky.

[73] Assignee: General Electric Company, Louisville, Ky.

[21] Appl. No.: 911,615

[22] Filed: May 31, 1978

[51] Int. Cl.[3] ..... H05B 6/68; H05B 6/72

[52] U.S. Cl. ..... 219/10.55 B; 219/10.55 R; 219/10.55 M; 219/486; 307/41

[58] Field of Search ..... 219/10.55 B, 10.55 E, 219/10.55 R, 484, 485, 486, 492, 493; 323/23, 25; 307/38, 39, 40, 41; 328/70

[56] References Cited

U.S. PATENT DOCUMENTS

| | | | |
|---|---|---|---|
| 3,028,472 | 4/1962 | Baird | 219/10.55 B X |
| 3,081,392 | 3/1963 | Warner | 219/10.55 B |
| 3,128,362 | 4/1964 | Clark et al. | 219/486 X |
| 3,453,415 | 7/1969 | Hermes et al. | 219/486 |
| 3,457,430 | 7/1969 | Samuelson | 307/41 |
| 3,523,170 | 8/1970 | Boehm | 219/10.55 B |
| 3,569,656 | 3/1971 | White et al. | 219/10.55 B |
| 3,717,300 | 2/1973 | Evalds | 219/486 X |
| 3,901,308 | 8/1975 | Berger | 307/39 X |
| 3,980,943 | 9/1976 | Cailleux et al. | 307/39 X |
| 4,020,358 | 4/1977 | Wyland | 307/39 |
| 4,188,520 | 2/1980 | Dills | 219/10.55 B |

*Primary Examiner*—C. L. Albritton
*Assistant Examiner*—Philip H. Leung
*Attorney, Agent, or Firm*—Bernard J. Lacomis; Radford M. Reams

[57] ABSTRACT

A time ratio control system for a microwave oven including a food surface browning system of relatively high thermal mass and operated from a limited power source. It is recognized that, since thermal (infrared) radiation is proportional to the fourth power of the absolute temperature of the radiating body, effective browning operation requires that the browning unit be allowed to reach at least a minimum temperature. Each cooking operation has a plurality of energization intervals of said microwave energy generating system and a plurality of effective browning intervals during which the browner is energized. To ensure effective browning, each effective browning interval has at least a predetermined minimum duration selected to allow the browning system time to reach at least a minimum effective temperature.

9 Claims, 8 Drawing Figures

10
20
18
24
26
22
34
32
36
23
28
12
14

74
L1
80
MICROWAVE GENERATING SYSTEM
126
172
84
92
88
156
158
166
170
128
152
150
162
164
168
174
160
N
100
60

1200°
1100°
1000°
900°
800°
700°
BROWNER SHEATH TEMPERATURE °F.
3 MIN.
38
BROWNER "ON"
40
40
BROWNER "ON" TIME = 20 SEC.
PERIOD = 30 SEC.
TIME

1200°
1100°
1000°
900°
800°
BROWNER SHEATH TEMPERATURE °F.
1 MIN
BROWNER "ON"
BROWNER "ON" TIME = 2 MIN.
PERIOD = 3 MIN.
TIME

EFFECTIVE TIME RATIO BROWNING IN A MICROWAVE OVEN EMPLOYING HIGH THERMAL MASS BROWNING UNIT

CROSS-REFERENCE TO RELATED APPLICATIONS

This invention is an improvement and a specific embodiment of the invention which is the subject matter of commonly-assigned copending application Ser. No. 911,555, filed May 31, 1978, by Raymond L. Dills and entitled "Effective Concurrent Microwave Heating and Electrical Resistance Heating in a Countertop Microwave Oven" now U.S. Pat. No. 4,188,520. A further improvement of this invention is the subject matter of commonly-assigned copending application Ser. No. 911,614, filed 911614, by Thomas R. Payne and Bohdan Hurko, and entitled "Optimum Time Ratio Control System for Microwave Oven Including Food Surface Browning Capability."

BACKGROUND OF THE INVENTION

The present invention relates generally to microwave ovens including supplementary electrical resistance browning elements and, more particularly, to such an oven which is adapted for operation from an approximately 1500 watt electric power source and which employs an electrical resistance browning element having a relatively high thermal mass.

Ovens employing microwave energy to rapidly cook food have come into widespread use in recent years. While microwave cooking generally has the advantage of being faster than conventional cooking, it has long been recognized that conventional cooking is superior in certain respects. In particular, for some types of food, microwave cooking is considered unsatisfactory by many people for the reason that there is usually only a slight surface browning effect, especially where a relatively short cooking time is employed.

To realize the benefits of both methods, a number of combination microwave and conventional cooking ovens have been proposed and commercially produced. These ovens, as their name implies, combine in a single cavity the capability of microwave cooking and conventional cooking by electrical resistance heating. The microwave cooking capability is provided by a microwave energy generating device such as a magnetron which produces cooking microwaves when energized from a suitable high voltage DC source. For conventional cooking and browning capability, sheathed electrical resistance heating elements, commonly called broil and bake elements, are usually provided at the top and bottom of the cooking cavity respectively.

Several of these combination oven designs have proven to be quite satisfactory in operation and commercially successful. They are typically full-size ovens operated from a 240 volt power source having a current-supplying capability which, for practical purposes, is unlimited. Therefore, simple switching schemes may be employed to selectively energize either the microwave cooking capability, the conventional cooking capability, or both capabilities simultaneously. Many thousands of watts of power are available from the power source, and this is sufficient to heat a domestic sized cooking oven in any manner desired.

More recently, so-called countertop microwave ovens have been introduced. These ovens typically have a somewhat smaller cooking cavity compared to a full-size conventional oven, and are designed for operation from a 115 volt, 15 amp household branch circuit. To meet UL requirements, an appliance designed for operation from such a power source is limited to a maximum steady state requirement of 13.5 amperes. This corresponds to approximately 1550 watts. As explained next, this limited power source capability results in some particular problems.

A typical microwave energy generating system intended for a countertop microwave oven requires a major portion of this available power. Such a typical system comprises a magnetron which produces between 400 and 600 watts of output power at a frequency of 2450 MHz, and a suitable power supply for the magnetron. A typical microwave energy generating system has an energy conversion efficiency in the order of 50%. In addition to the microwave energy generating system, a practical microwave oven includes a number of low power load devices such as lamps, fan motors, and control circuitry. As a typical example, altogether one particular commercially-produced countertop microwave oven model draws approximately 11.2 amps RMS from a 115 volt line for microwave cooking alone. This corresponds to approximately 1300 watts.

For effective and reasonable rapid browning, the watts density over the area of the food covered by a supplementary electrical resistance browning element should be approximately 20 watts per square inch. With 1200 watts of available browning power, approximately 60 square inches could be covered by radiation from such a browning element. Even 60 square inches is a relatively small area, and any decrease in available browner power would reduce the amount of area even further. As a result, substantially all of the limited available power should be supplied to the browning element.

Therefore, for an oven designed for operation from a 115 volt, 15 amp household branch circuit, as a practical matter the limited power available precludes the simultaneous energization of the microwave energy generating system and the supplementary electrical resistance browning units at their respective full rated power levels, which, particularly in the case of the browning element, is required for effective operation.

In answer to this practical limitation on available power, designers of countertop microwave ovens intended for operation from a power source insufficient to supply both the microwave and electrical resistance browning capabilities simultaneously at their respective full rated power levels have resorted to a two-step cooking procedure whereby cooking by microwave energy is accomplished first, with the electrical resistance browning element de-energized. Next the microwave source is de-energized and the electrical resistance browning element is energized for the remainder of the cooking cycle.

As an alternative to a separate electrically energized heating element for browning, a number of special utensils have been proposed and commercially produced to effect browning when used in a microwave oven. These utensils comprise an element, for example a thin resistive film applied to an undersurface of the utensil, which element has the capability of absorbing some of the microwave energy available in the cooking cavity and converting the same to heat. The utensil itself becomes sufficiently hot for browning or searing. In a similar vein, devices have been proposed which alter the electromagnetic energy field within the cooking cavity so as to produce near field dielectric heating for improved surface browning. It will be appreciated that while such devices are beneficial with certain foods, the microwave energy they absorb is then unavailable for direct heating of the food. Additionally, they are not as efficient as direct electrical resistance heating because the less-than-100% energy conversion efficiency of the microwave energy generating system must be taken into account.

While not directly related to browning, an important feature included in many microwave ovens is a variable microwave power level control. Variable power level control provides flexibility in cooking various types of food, including thawing frozen foods at a reduced power level. One particular power level control scheme which is employed in microwave ovens is duty cycle power level control whereby the microwave energy source is repetitively switched from full OFF to full ON, with the duty cycle under control of the user of the oven. In this way, the time averaged rate of microwave heating can be effectively controlled. The repetition period may vary from in the order of one second for fully electronic duty cycle power level controllers, to in the order of thirty seconds for electromechanical cam operated duty cycle power level controllers.

In accordance with the invention which is the subject matter of the above-mentioned Dills U.S. Pat. No. 4,188,520, effective microwave and electrical resistance heating is accomplished concurrently by a time ratio control system which alternately energizes the microwave energy generating system and the electrical resistance heating system a plurality of times during each cooking operation. This in effect time shares the available power. Actual cooking tests have shown that this gives superior results when compared to the two-step cooking process. One reason for the superior results is that during those periods when the microwave energy source is de-energized and the electrical resistance heating system is energized, the temperature throughout the body of the food being heated is given time to equalize. As is known, many microwave cooking ovens do not have perfectly uniform microwave energy distribution within the cavity, and as a result hot spots and cold spots within the body of food are produced. A common microwave cooking technique is to allow a waiting or "equalization" period during which heat flows from warmer to cooler regions within the body of food. When the time sharing concept is employed, gradual equalization occurs at a number of times during the cooking cycle. Less time is required for final equalization at the end of a cooking operation, and, more importantly, short term temperature differentials are minimized so that the presence of slightly overcooked regions is minimized.

Another benefit of the time sharing approach is partly cosmetic in nature and is apparent when a user observes the food while it is cooking. During conventional cooking, food gradually browns throughout the cooking process. However, with the prior art two-step cooking process employed with microwave oven browner systems, browning does not occur until near the end. With time sharing, browning and cooking progress more nearly resembles that which occurs during conventional cooking, and the result is visually more pleasing than the "two-step" approach. Further, it is believed that the actual cooking results are more similar to that which is achieved in conventional cooking.

The present invention is an improvement of the Dills invention, which improvement relates to the specific case where the electrical resistance heating element is an infrared radiant browning element comprising a sheathed electrical resistance heating unit which inherently has a relatively high thermal mass. Such a heating unit generally comprises a heating element in the form of a spiraled electrical resistance wire encased in an elongated, ceramic-filled metal outer sheath which is electrically conductive and preferably is grounded for safety and to avoid the absorption of microwave energy. The ceramic material transmits heat, but is an electrical insulator. A suitable ceramic material is magnesium oxide. Thus, the outer sheath becomes hot, but normally remains electrically insulated from the heating element. The design of such heaters is highly developed, and at present they are rugged, highly reliable, and, due to the grounded electrically conductive outer sheath, are relatively safe. Thus, in many respects they are an ideal heating element for use in ovens, and in fact are widely so used.

In accordance with the present invention, a specific shortcoming of a sheathed electrical resistance heating unit having a relatively high thermal mass when used as a browning element in a time sharing system such as is disclosed in the Dills U.S. Pat. No. 4,188,520 is recognized and effectively alleviated.

SUMMARY OF THE INVENTION

Accordingly, it is an object of the invention to provide a cooking oven including a time sharing system for apportioning available power between a microwave energy generating system and a food surface browning system of relatively high thermal mass, which time sharing system effectively alleviates disadvantages arising from the thermal mass of the food surface browning system.

The present invention is applied to time sharing combination microwave ovens employing a particular type of browning element which has its parameters determined by a number of practical considerations. First, for most effective radiant browning, the browning element should use substantially all of the available power, which is approximately 1200 to 1400 watts. Secondly, practical sheathed electrical resistance heating units of the type previously described inherently have a relatively high thermal mass. A thermal mass within the approximate range of 0.05 to 0.09 BTU/°F is typical. Such units, when supplied with the approximately 1200 to 1400 available watts previously mentioned, have a resultant heat up rate in the order of 13 °F/second to 26 °F/second.

The present invention is based upon a recognition that, since thermal (infrared) radiation is proportional to the fourth power of the absolute temperature of the radiating body, effective browning operation requires that the browning unit be allowed to reach at least a minimum temperature. Due to the fourth power relationship, radiant browning becomes disproportionately more effective as browner temperature increases.

Briefly stated, and in accordance with one aspect of the invention, in a time sharing microwave oven employing a browning system of relatively high thermal mass supplied from a limited power source, each cooking operation has a plurality of effective browning intervals during which the electrical resistance food surface browning system is energized, each effective browning interval having at least a predetermined minimum duration selected to allow the browning system time to reach at least a minimum effective temperature. In accordance with another, more particular, aspect of the invention, the minimum duration of the effective browning intervals is approximately thirty seconds.

The invention thus provides a practical means for utilizing a browning unit of relatively high thermal mass to provide efficient browning operation. Accordingly, the many advantages of a sheathed electrical resistance heating unit may be obtained.

When the present invention is employed, improved browning efficiency results for at least two reasons. First, since radiant browning energy is proportional to the fourth power of absolute browning system temperature, the minimum browner ON time ensures that the browning system reaches the higher temperatures at which disproportionately large amounts of radiant energy are produced. Second, an approximate threshold can be defined, for example 900° F., below which browning is ineffective, and above which browning becomes increasingly more effective. As browner ON time lengthens, this threshold temperature is reached earlier in a cooking cycle, with the result that effective browning occurs throughout a greater portion of each cooking cycle, particularly where cooking cycles are relatively short.

It should be noted that in accordance with the present invention "effective browning intervals" have at least a minimum duration. However, this does not preclude the possibility of there being other periods of energization of the food surface browning system during a cooking operation which are shorter than required for an "effective browning interval." For example, in the system described and claimed in the above-mentioned application Ser. No. 911,614, there are, in addition to "effective browning intervals," other periods of energization of the food surface browning system of much shorter duration. In the above noted system, these shorter browner energization periods are used to keep the browner warm between "effective browning intervals," and to preheat the browner at the beginning of a cooking operation.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
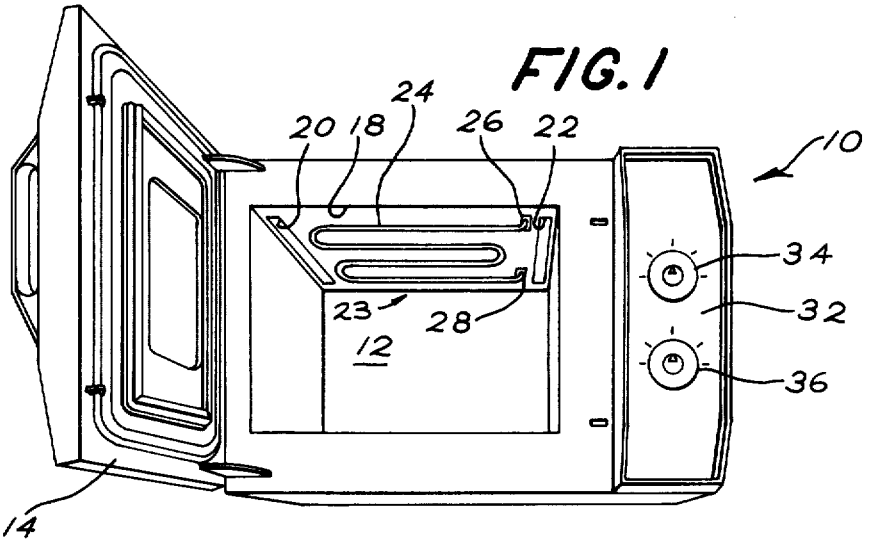
FIG. 1 is a front perspective view of a countertop microwave oven with the access door open to permit viewing of a serpentine sheathed electrical resistance browning unit located at the top of the cooking cavity.

Referring first to FIG. 1, there is shown a countertop microwave oven 10 including a cooking cavity generally designated 12 and an access door 14 for closing the cooking cavity 12.

For supplying microwave energy to the cavity 12, the top wall 18 of the cavity 12 includes a pair of apertures 20 and 22 which couple microwave energy from a waveguide system (not shown) supplied by a magnetron (not shown) into the cavity 12. It will be appreciated that the microwave feed system illustrated is exemplary only and does not form any part of the present invention. As another example, instead of the pair of apertures 20 and 22, a single, larger, centrally located aperture covered by a suitable heat resistant plate (not shown) which is transparent to microwave energy might be employed.

For food surface browning, an electrical resistance food browning system, generally designated 23, is positioned within the cavity 12 so as to brown by radiant heat energy the surface of food being cooked therein. More specifically, the food browning system illustrated comprises a sheathed electrical resistance heating unit 24 of serpentine configuration positioned generally adjacent to but spaced from the top wall 18 of the cooking cavity 12. Preferably the top wall 18 is reflective of infrared energy. The ends 26 and 28 of the browning element 24 are suitably terminated at the top wall 18, the electrical leads (not shown) therefrom being connected to circuitry (FIG. 4) within an electrical components compartment located generally to the right of the cooking cavity 12.

The heating unit 24 is of the type previously mentioned which has a heating element in the form of a spiraled electrical resistance wire encased in an elongate ceramic-filled metal outer sheath, the outer sheath portion being visible in FIG. 1. Considering the dimensions of the heating unit 24, the diameter is a compromise dictated by the inherent nature of a sheathed electrical resistance heating unit. The smaller the diameter of the heating unit 24, the faster it heats up when supplied with power at a given rate. However, the diameter cannot be decreased too much. Practical manufacturing considerations dictate a range of from about 0.22 to 0.27 inches in diameter as a compromise between heat up rate and manufacturability.

A typical heated length for the serpentine sheathed electrical resistance heating unit 24 is forty to forty-eight inches. The resultant thermal mass is within the approximate range of 0.05 to 0.09 BTU/°F. For an approximately 1200 to 1400 watt heating unit, the heat up rate is in the order of 13° F./second to 26° F./second.

To prevent the heating unit 24 from "loading in" or absorbing microwave energy, its outer sheath is grounded at both ends and its over-all length is selected to be equal to an integer multiple of one-half wavelength, plus one-fourth wavelength. One suitable over-all length for an oven operating at a microwave frequency of 2450 MHz is 44.4 inches.

While the browning system 23 illustrated comprises a single sheathed electrical resistance heating unit 24, it will be appreciated that the browning system 23 could as well comprise a plurality of sheathed electrical resistance heating units connected electrically in series or in parallel as required to achieve the proper total wattage and equivalent resistance. For a 1200 to 1400 watt browning system operated from 115 volts, by Ohm's law, the electrical resistance should be approximately 11.0 to 9.4 ohms.

A control panel 32 generally to the right of the cooking cavity 12 and forming the front of the aforementioned components compartment includes an upper control knob 34 to enable a user of the oven to select the total duration of a cooking operation. The duration of a cooking operation may be selected by the control knob 34 to range from as little as a minute or less, up to an hour or more, depending upon the particular food being cooked. Alternatively, the duration of a cooking operation need not be precisely determined as a function of time, but instead may be selected to end when the interior temperature of the food being cooked has reached a predetermined temperature representing a desired degree of doneness. This may be accomplished for example by employing a temperature sensing probe and circuit such as is disclosed in U.S. Pat. Nos. 3,975,720-Chen and Fitzmayer, 3,991,615-Hornung, and 4,035,787-Hornung, the entire disclosures of which are hereby incorporated by reference.

The control panel 32 also includes several controls which may be employed by a user to apportion the available power between the microwave energy generating system and the food surface browning system. Specifically, there is an apportionment control 36 which functions to control the time ratio between the energization of the microwave energy source and the energization of the browning unit 26.

Figure 2:
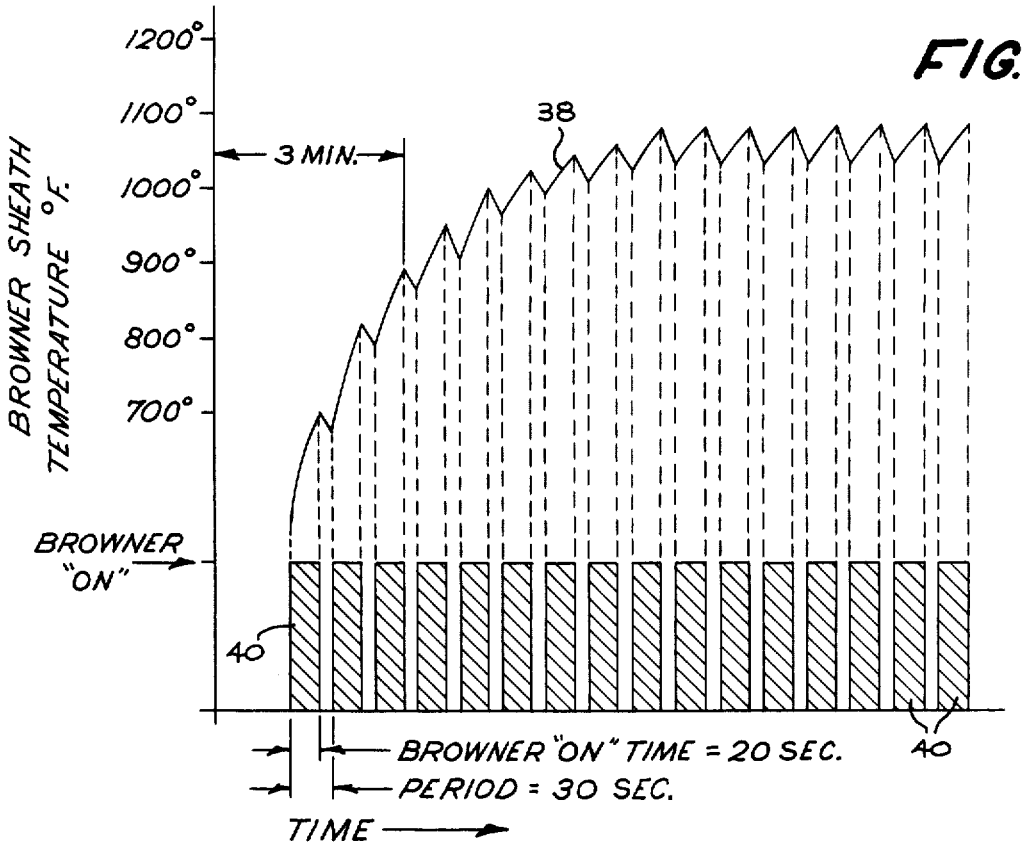
FIG. 2 is a graph depicting the surface temperature of the browning unit of FIG. 1 as the browning unit is repetitively energized, with the period of one cycle being thirty seconds and the duty cycle being 66⅔%.

Referring next to FIG. 2, there is shown a plot in which a line 38 represents the surface temperature of the outer sheath of the browning unit 24 as a function of time, where the browning unit 24 is cyclically energized for twenty-second intervals out of each thirty-second repetition period. The vertical bars 40 in a lower portion of FIG. 2 indicate those intervals when the browning unit 24 is energized. The spaces between the vertical bars 40 indicate those intervals when the browning element 24 is not energized. It is during these in between intervals that the microwave energy generating system may be energized. (Intervals of microwave energization are not specifically designated as such in FIG. 2 because FIG. 2 is intended to illustrate the effect of ON time on the temperature of the browning element 24.)

More specifically, the plot of FIG. 2 was produced by measuring the outer sheath temperature of a sheathed electrical resistance heating element by means of a thermocouple spot welded to the sheath. The heated portion of the particular sheathed electrical resistance heating element was 48 inches long, and 0.22 inches in diameter. When ON, it had an electrical power input of 1500 watts.

Figure 3:
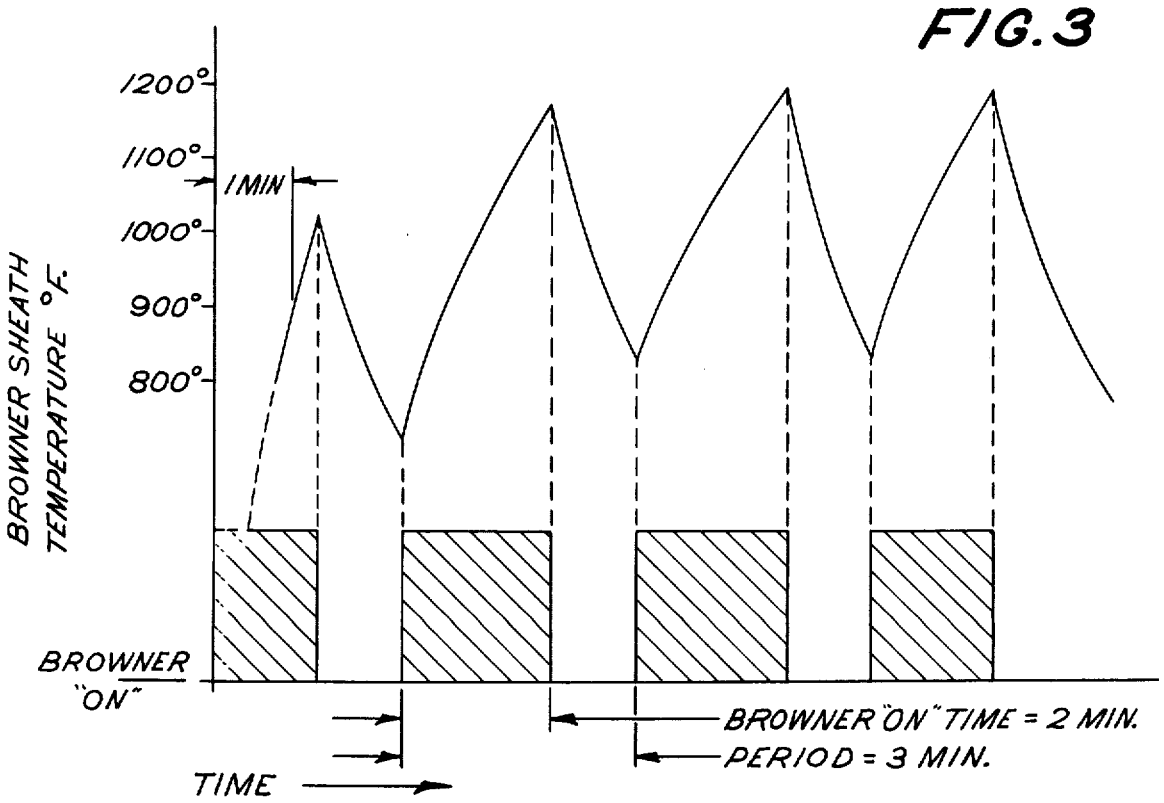
FIG. 3 is a graph similar to FIG. 2 except that the cycle period is lengthened to three minutes, with the duty cycle remaining at 66⅔%.

Referring now, in addition to FIG. 2, to FIG. 3, a similar plot is shown. FIG. 3 differs in that each interval of browner ON time is two minutes, out of a total period of three minutes. In FIG. 3 the browner duty cycle remains unchanged at 66⅔%, while the repetition period is lengthened by a factor of six, to three minutes.

Now contrasting the plots of FIGS. 2 and 3, it can be seen in FIG. 3 where the browning element 24 is energized for relatively longer continuous intervals, the peak temperature reached is higher. Specifically, the peak temperature reached in FIG. 3 is approximately 1180° F. By comparison, the peak temperature reached in FIG. 2 is only approximately 1080° F. As previously mentioned, since thermal radiation is proportional to the fourth power of absolute sheath temperature, a disproportional greater amount of infrared radiant energy is produced during the peak. More effective food surface browning results.

In addition, if a somewhat arbitrary threshold is selected, for example 900° F., below which browning is defined to be relatively ineffective and above which browning is defined to be relatively effective, it can be seen that with the relatively longer browner ON time of FIG. 3, this temperature is reached much earlier in a cooking cycle. Specifically, in the specific example of FIG. 3, 900° F. is reached in about one minute, contrasted to three minutes for FIG. 2. Therefore, and especially for shorter overall cooking cycles, the browning element temperature remains in the effective range for a relatively longer proportion of the total time where relatively longer browner ON times are employed. It will of course be appreciated that the 900° F. threshold, being somewhat arbitrary, may be varied according to definitional preference, but that the general principle remains unchanged.

In the FIG. 2 plot, the represented browner ON time of twenty seconds is less than the approximately thirty seconds minimum which is required in accordance with one aspect of the present invention, and thus may be expected not to perform as well as that of FIG. 3. Specifically, the plot of FIG. 2 is a plot which may be produced by apparatus according to the invention in the Dills U.S. Pat. No. 4,188,520, and is here illustrated only for purposes of comparison because it provides a marked contrast to that of FIG. 3.

Figure 4:
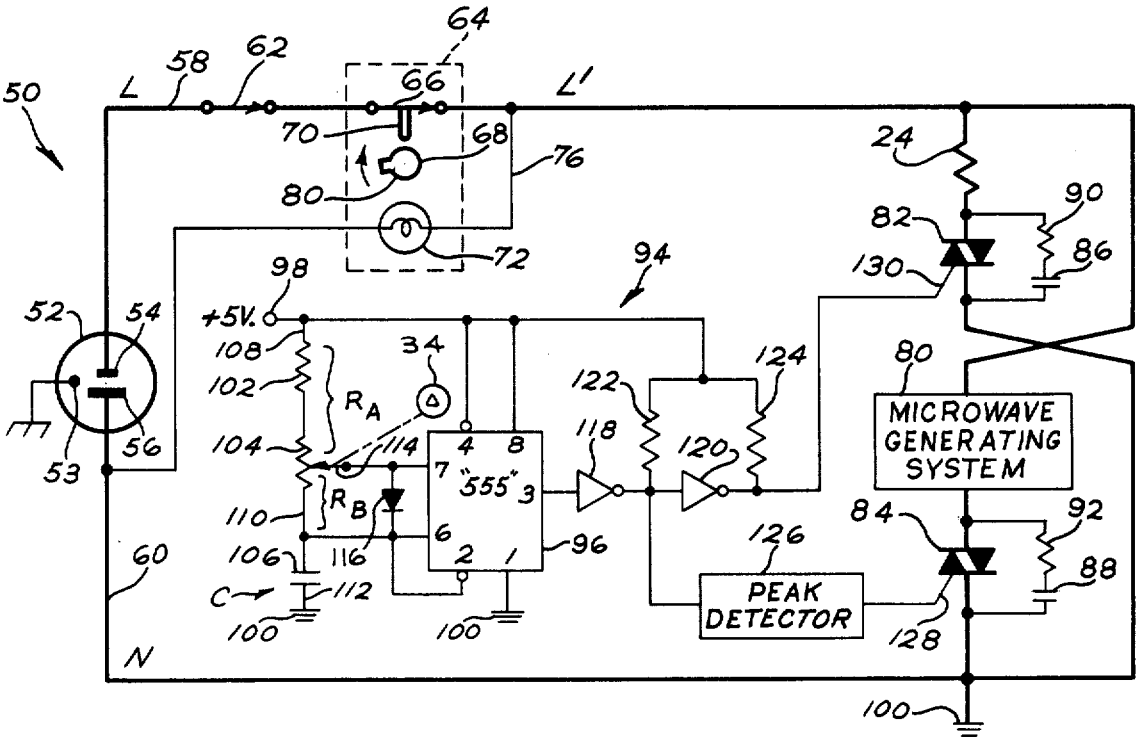
FIG. 4 is an electrical schematic diagram of a circuit according to one embodiment of the invention.

Referring now to FIG. 4, there is shown an electrical schematic diagram of an exemplary circuit 50 which may be employed to practice the present invention. In FIG. 4, the power portion of the circuit is denoted by relatively heavier lines, and the control portion of the circuit is denoted by relatively lighter lines.

Considering first the power portion, a standard 115 volt, 15 amp plug 52 is provided for mating with a conventional household branch circuit receptacle. The plug 52 has a ground pin 53 connected to a cabinet ground for safety, and L and N prongs 54 and 56. The L and N prongs 54 and 56 supply L and N power conductors 58 and 60, respectively.

Interposed in series with the L conductor 58 is a switch 62 which is representative of several switches and relay contacts coventionally employed in microwave ovens. For example, typically there is a main power switch or relay and also various safety interlock switches which serve, for example, to prevent operation unless the door 14 is closed.

In order to establish the total overall time duration of a cooking operation, a cooking timer 64 is provided, as indicated by a highly schematic representation thereof. The representative timer 64 comprises a cam operated switch 66 operated by a rotating cam 68 through a link 70. A timing motor 72 drives the rotating cam 68. The switch 66 is connected in the L conductor 58 in series with the switch 62 so as to energize an L′ line 74 when closed as illustrated. The leads 76 and 78 of the timing motor are connected to the L' line 74 and the N line 60 respectively. By means of a suitable connection (not shown) to the control knob 36 (FIG. 1), the duration established by the timer 64 is user variable according to the type of food being cooked, and can range from less than a minute to an hour or more.

While the highly schematic timer 64 is illustrated, it will be appreciated that many types of cooking timers are possible, including fully electronic timers. Moreover, as mentioned above, the total overall time duration of a cooking operation may not actually be specified by the user of the oven as a function of time, but might instead by established by a food temperature sensing probe and suitable circuitry to sense when the interior temperature of the food being cooked has reached a desired degree of doneness.

In the operation of the timer 64, the user control 36 positions the cam 68 to a desired starting position, the exact starting position depending upon the length of cooking time desired. The cam 68 then rotates until eventually the protrusion 80 contacts the link 70 to open the switch 66. At this point power to the L' line 74 is interrupted, terminating the cooking operation.

To complete the power circuitry, the browning element 24 and a microwave generating system 80 are each connected between the L' conductor 74 and the N conductor 60 through individual controlled switching elements in the form of triacs 82 and 84. When the corresponding triac 82 or 84 is gated, either the browning element 24 or the microwave generating system 80 is energized. For each of the triacs 82 and 84, a protective network comprising a series capacitor 86 or 88 and a resistor 90 or 92 is connected across the main triac terminals.

The microwave generating system 80 is preferably a conventional one comprising a permanent magnet magnetron supplied by a half wave doubler power supply including a ferroresonant transformer as the power supply input element.

Exemplary control circuitry 94 which supplies suitable gating signals to the triacs 82 and 84 to alternately energize the heating element 24 and the microwave generating system 80 will now be described. It will be appreciated that as the control system illustrated and described herein is exemplary only, many variations are possible.

The control circuitry 94 comprises a fixed period, variable duty cycle square wave oscillator comprising an astable multivibrator built around a "555" monolithic timer IC 96. Pin numbers shown for the timer IC 96 are those for an 8 pin, dual inline package (DIP). A conventional power supply (not shown) supplies +5 volts DC to a supply terminal 98 referenced to a circuit reference point 100, which is also connected to the N power source conductor 60. Power for the power supply may be derived through suitable connections (not shown) to the L' and N conductors 74 and 60.

The positive DC supply Pin 8 of the IC 96 is connected to the supply terminal 98, and the IC ground Pin 1 is connected to the circuit reference point 100. The reset Pin 4 is unused and is thus tied to the positive supply terminal 98. Pin 3 is the output of the IC 96. A fixed timing resistor 102, a user variable potentiometer 104 mechanically connected for operation by the apportionment control 34, and a timing capacitor 106 are serially connected and together determine the period and duty cycle of the timer. The free terminal 108 of the fixed timing resistor 102 is connected to the DC supply terminal 98, and the lower terminal 110 of the potentiometer 104 is connected to sensing Pins 6 and 2 of the IC timer 96, in addition to the capacitor 106. The lower capacitor terminal 112 is connected to the reference point 100. To complete the timer circuit, the movable potentiometer contact 114 is connected to the discharge Pin 7 of the timer IC 96, and a charging current bypass diode 116 is connected between the movable potentiometer contact 114 and the lower potentiometer terminal 110.

As an aid to understanding the operation of the timer, the resistances of the fixed timing resistor 102 and that portion of the potentiometer 104 which is above the movable contact 114 are together designated $R_A$. The resistance of that portion of the potentiometer 104 which is below the movable contact 114 is designated $R_B$. The value of the timing capacitor 106 is designated C.

In operation, the "555" IC 96, through its Pins 2 and 6, senses the voltage on the timing capacitor 106. Depending upon the voltage so sensed, the "555" IC either open circuits the discharge Pin 7, or internally grounds Pin 7. When Pin 7 is open, the capacitor 106 charges through the resistance $R_A$ and the bypass diode 116 toward the potential at the positive DC supply terminal 98. When the voltage on the capacitor 106 reaches two thirds of the DC supply voltage, as sensed by Pin 6, the discharge Pin 7 goes low and the capacitor 106 discharges through the resistance $R_B$. When the capacitor 106 voltage falls to one third of the DC supply voltage, as sensed by Pin 2, the discharge Pin 7 again opens, to continue the oscillation cycle.

To provide an output at the same time, the internal arrangement of the IC 96 is such that the output Pin 3 is high when the discharge Pin 7 is open and the capacitor 106 is charging, and the output Pin 3 is low when the discharge Pin 7 is low and the capacitor 106 is discharging. As a result, the $R_AC$ time constant determines the length of the interval when the output Pin 3 is high, and the $R_BC$ time constant determines the interval when the output Pin 3 is low. By moving the position of the potentiometer movable contact 114 through operation of the control knob 34, the user of the oven varies the ratio of the time intevals during which the output Pin 3 is high and low, thereby varying the ultimate duty cycles of the browning element 24 and the microwave generating system 80 through further connections hereinafter described.

The characteristics of the timer IC 96 are such that the times in seconds are 1.1 times the RC products previously mentioned. Since C is constant in both cases and the total resistance remains the same and is merely apportioned between $R_A$ and $R_B$, the total oscillation period remains substantially constant, but the duty cycle varies. The provision of the fixed timing resistor 102 determines the minimum time required to charge the capacitor 106 up to the threshold voltage sensed by Pin 6, and is employed to fix the minimum browner ON time.

Considering now the output connection of the "555" IC timer 96, the output Pin 3 is connected through a pair of buffers in the form of TTL inverters 118 and 120. To provide sufficient output current capability, each of the inverters 118 and 120 may comprise several parallel TTL inverters. A pair of pull up resistors 122 and 124 connect the outputs of the inverters 118 and 120 to the positive DC supply terminal 98. The positive DC supply and ground pins (not shown) of the inverters 118 and 120 are connected to the terminals 98 and 100.

To energize the microwave generating system 80 when the output Pin 3 is low, the output of the first inverter 118 is connected through a peak detector network 125 to the gate lead 128 of the triac 84. The function of the peak detector network 126 is to minimize current surges which could result when power is first applied to the inductive load presented by the power transformer primary winding of the microwave generating system 80. To this end, the peak detector network 126 implements a synchronous switching technique whereby gating signals can initially be supplied to the triac 84 only in coincidence with an approximate voltage peak of the incoming AC voltage waveform, which corresponds to an instant of approximately zero current. For completeness, a suitable peak detector network 126 is described hereinafter with particular reference to FIG. 8.

Finally, to energize the browning element 24 when the output Pin 3 is high, the output of the second inverter 120 is connected directly to the gate lead 130 of the triac 82.

Figure 5:
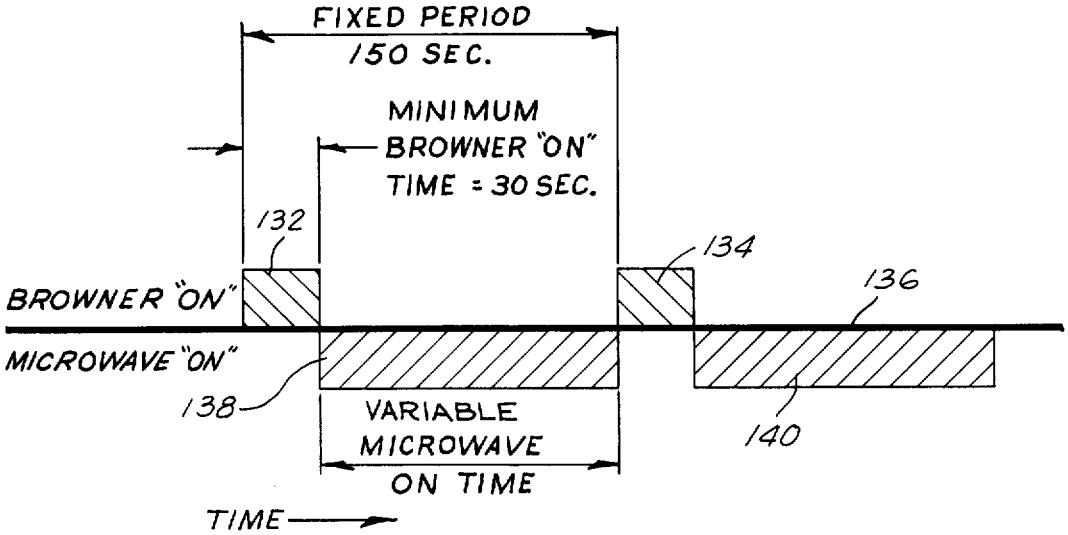
FIG. 5 is a graph depicting a control output of the circuit of FIG. 4 as a function of time.

Referring now to FIG. 5, the output signals for two complete oscillation periods of the timer circuit of FIG. 4 are depicted. The cycle repeats until such time as the cooking timer 64 terminates the cooking operation. In FIG. 5, the shaded blocks 132 and 134 above the horizontal axis 136 represent time intervals during which the IC output Pin 3 is high, the triac 82 is gated, and the browning element 24 is energized (BROWNER "ON"). The shaded blocks 138 and 140 below the horizontal axis 136 represent time intervals during which the output Pin 3 is low, the triac 84 is gated and the microwave generating system 80 is energized (MICROWAVE "ON").

From FIG. 5, it can be seen that the circuit 50 of FIG. 4 alternatively energizes the browning unit 24 and the microwave generating system 80. In this particular embodiment, the period of one cycle is fixed at approximately one hundred fifty seconds. The relative duty cycles of the energization of or, expressed alternatively, the time averaged power apportionment between, the browner unit 24 and the microwave energy generating system 80 are variable. The energization duty cycle however is not infinitely variable, as the minimum browner ON time determined by the fixed resistor 102 is appoximately thirty seconds.

The particular time intervals represented in FIG. 5 occur when the apportionment control 34 is set for maximum microwave power and minimum browner power. In this case, the browner ON time is set at the minimum thirty seconds. Although from the relative time ratios shown it might appear that the setting is 20% browner and 80% microwave (and this is true on a strict duty cycle basis), the actual percentage of browning effectiveness is much less than 20%. In fact, since during the earlier portions of the browner 24 energization periods 132 the browner 24 is warming up and not accomplishing effective radiant browning, the depicted energization waveform might be considered as for just above zero browning.

It has been found that, for a particular browning unit 24, thirty seconds is the minimum effective browning time and browner ON times of less than thirty seconds are substantially ineffective.

As the apportionment control 34 (FIG. 1) and thus the position of the movable potentiometer contact 114 is varied, the blocks 132 and 134 representing browner ON time become longer, and the blocks 138 and 140 representing microwave ON time become shorter. Thus the effective percentage of browner power may be increased, with an attendant decrease in microwave power.

Figure 6:
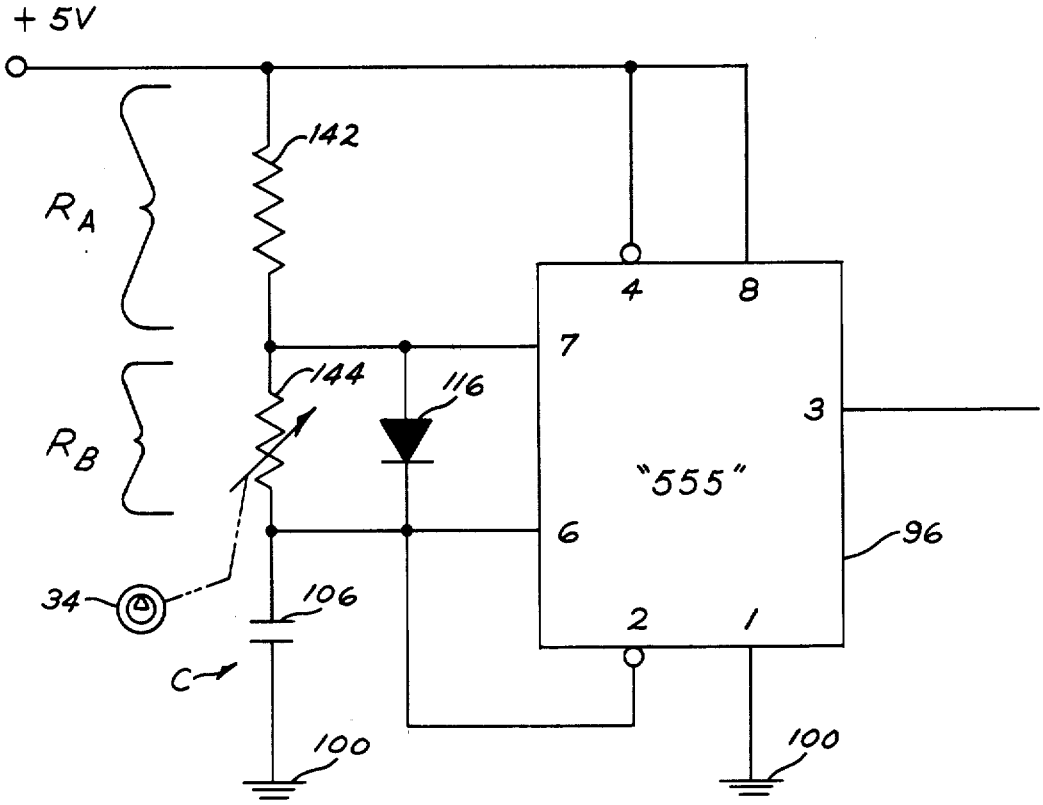
FIG. 6 is an electrical circuit diagram of a modification of the circuit of FIG. 4.

As an alternative, the circuit 50 of FIG. 4 may be modified as shown in FIG. 6 to produce a variable duty cycle, variable period control oscillator. In FIG. 6 the timing components associated with the "555" IC timer 96 are changed. Specifically, the $R_A$ resistance is fixed, comprising a single fixed resistor 142, and not any variable portion. The resistance $R_B$ comprises a variable resistor 144 connected to the user variable apportionment control 34.

Figure 7:
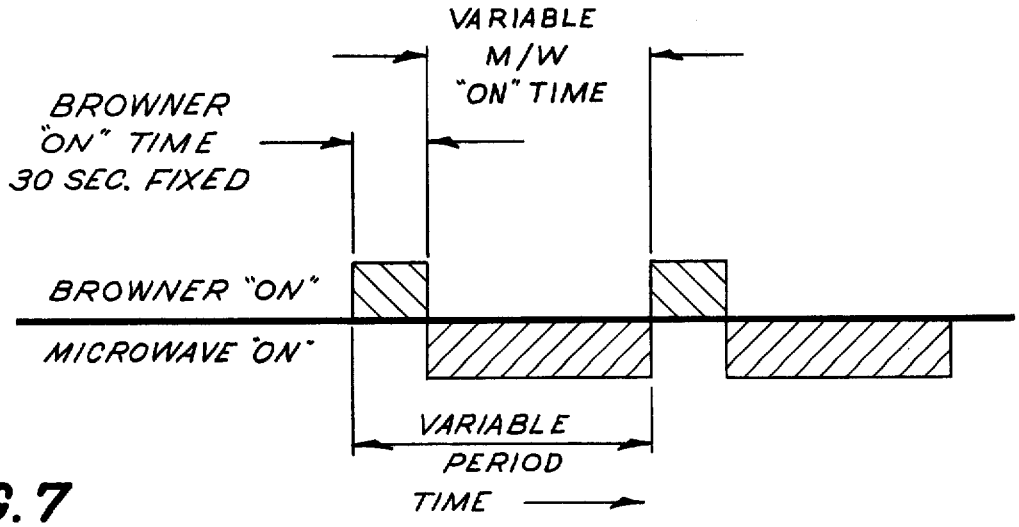
FIG. 7 is a graph similar to that of FIG. 5 showing the control output of the circuit as modified by FIG. 6.

Referring to FIG. 7, in addition to FIG. 6, the output waveform which results will now be described. The $R_AC$ time constant determines the length of time the output Pin 3 is high and thus the time the browner element 24 is energized. In this particular circuit, this time is fixed at thirty seconds. The time during which the output Pin 3 is low and the microwave generating system 80 is energized is variable down to nearly zero. This alternative system produces similar results. The energization waveforms of FIG. 7 illustrate that effective duty cycle control of browning unit 24 time averaged power can be achieved by fixing the browner ON time, and varying browner OFF time (microwave ON time). In FIG. 7, the intervals of browner ON time are at least at the minimum required for effective browning. Further, the relative duty cycle of the browner energization and the microwave energization are variable over a wide range. As the period is decreased (by decreasing the resistance of the variable resistor 144), the microwave energization times are decreased.

Figure 8:
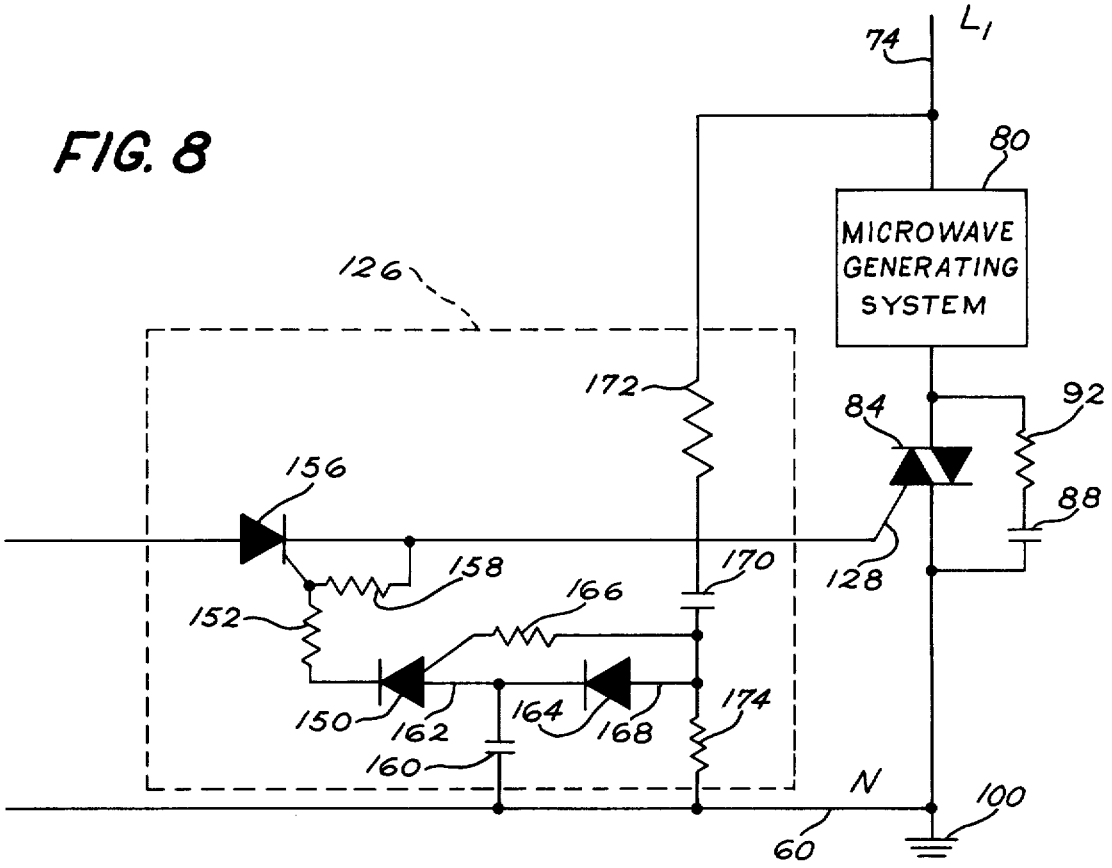
FIG. 8 is an electrical schematic diagram showing one example of circuitry suitable for the box labeled "peak detector" in the circuit of FIG. 4.

Referring lastly to FIG. 8, there is shown an exemplary circuit for the peak detector 126 of FIG. 4. The exemplary peak detector circuit 126 comprises a complementary SCR 150 having its cathode connected through a resistor 152 to the gate 154 of a gate/latch SCR 156. A resistor 158 connected between the gate 154 and the cathode of the gate/latch SCR 156 serves to improve the gate turn-on characteristics and to improve gate noise immunity. A capacitor 160 is connected between the anode 162 of the complementary SCR 150 and the circuit reference point 100. A charging path diode 164 has its cathode connected to the junction of the capacitor 160 and the SCR anode 162, and a resistor 166 parallels the diode 164. The anode 168 of the diode 164 is connected through a phase shift network comprising a series capacitor 170 and a resistor 172 to the L' conductor 74. To complete the phase shift network, a resistor 174 is connected between the diode anode 168 and the circuit reference point 100.

In the operation of the peak detector network 126, during every cycle of the incoming AC waveform when the voltage of the L' power source conductor 74 is instantaneously positive with respect to the N conductor 60, the capacitor 160 charges through the resistor 172 the capacitor 170 and the diode 164. Due to the forward voltage drop of the diode 164, the gate of the SCR 150 is supplied with a slightly higher positive potential through the resistor 166, and SCR gate-anode junction is reverse biased. Just after the instantaneous line voltage passes its peak value and begins to decrease, the diode 164 becomes reverse biased and ceases conducting. The capacitor 160 remains charged, maintaining voltage on the SCR anode 162. At this same time the gate voltage supplied through the resistor 166 is decreasing. The gate-anode junction of the complementary SCR 150 becomes forward biased, causing the SCR 150 to conduct and discharge the capacitor 160 into the gate 154 of the gate/latch SCR 156. As a result, the gate/latch SCR 156 permits the triac 84 to be triggered into conduction by the output of the inverter 118 (FIG. 4) only in approximate coincidence with a voltage peak of the incoming AC waveform.

The following Table lists component values which have been found to be suitable in the circuits described herein. It will be appreciated that these component values as well as the circuits themselves are exemplary only and are provided to enable the practice of the invention with a minimum amount of experimentation.

TABLE

| | |
|---|---|
| Resistors | |
| 24 | 1200 watt sheathed electrical resistance heating unit, 11 ohms |
| 90 | 150 ohm |
| 92 | 150 ohm |
| 102 | 250 K ohms |
| 104 | 1 Meg ohm potentiometer |
| 122 | 120 ohm |
| 124 | 120 ohm |
| 142 | 250 K ohms |
| 144 | 0 to 1 Meg ohm variable |
| 152 | 8.2 K ohm |
| 158 | 1 K ohm |
| 166 | 220 K ohm |
| 172 | 56 K ohm |
| 174 | 5.6 K ohm |
| Capacitors | |
| 86 | 0.1 mfd |
| 88 | 0.1 mfd |
| 106 | 200 mfd |
| 160 | 0.1 mfd |
| 170 | 0.1 mfd |
| Semiconductor Devices | |
| 82 | G.E. SC160DX4 Triac |
| 84 | G.E SC160DX4 Triac |
| 96 | Monolithic integrated circuit timer, Signetics NE555, Motorola MC1555, or equivalent |
| 116 | 1N4001 diode |
| 118 | 3 Texas Instruments SN7404 TTL inverters |
| 120 | 3 Texas Instructments SN7404 TTL inverters |
| 150 | G.E. C13 complimentary SCR |
| 156 | G.E. C103Y SCR |
| 164 | IN4001 diode |

It will be apparent therefore that the present invention provides an improved time sharing system in a microwave oven where power is shared on a duty cycle basis between a browner element and a microwave energy generating system.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. In a cooking oven having a cooking cavity, an electrical resistance food browning system positioned within the cavity so as to brown by radiant energy the surface of food being cooked therein, a microwave energy generating system supplying the cooking cavity, and a means for establishing the overall duration of a cooking operation, the oven adapted for operation from an electric power source insufficient to supply both the food browning system and the microwave energy generating system simultaneously, and the food browning system having a relatively high thermal mass such that its heat up rate is within the approximate range of 13° F./second to 26° F./second when drawing substantially all of the power available from the electric power source, a time ratio control system comprising:

power control means responsive to said means for establishing the overall time duration of a cooking operation for alternately energizing said microwave energy generating system and said electrical resistance food browning system, each cooking operation having a plurality of energization intervals of said microwave energy generating system and a plurality of effective browning intervals during which said electrical resistance food browning system is energized, and each effective browning interval having at least a predetermined minimum duration of at least thirty seconds selected to allow said browning system time to reach at least a minimum effective temperature.

2. A system according to claim 1, wherein said food browning system comprises at least one sheathed electrical resistance heating unit.

3. A cooking oven having both microwave heating and infrared food browning systems, which is adapted for operation from an electric power source limited to approximately 1500 watts, and wherein effective microwave heating and infrared food browning can be accomplished concurrently without exceeding the power source capability, said oven comprising:

means for establishing the overall time duration of a cooking operation;

a cooking cavity;

an electrical resistance food browning system positioned within said cooking cavity so as to brown by radiant heat energy the surface of food being cooked therein, said food browning system having a relatively high thermal mass within the approximate range of 0.05 to 0.09 BTU/°F., with a resultant heat up rate when supplied with approximately 1200 to 1400 watts within the approximate range of 26° F./second to 13° F./second, and said food browning system having an electrical resistance properly selected in view of the power source voltage to convert electrical power to heat at a rate within the approximate range of 1200 to 1400 watts;

a microwave energy generating system supplying said cooking cavity;

the total power which would be required by said electrical resistance heating element system and said microwave energy generating system together if operated simultaneously at their respective full rated power levels being in excess of the limited power available from the power source;

power control means responsive to said means for establishing the overall time duration of a cooking operation for alternately energizing said microwave energy generating system and said electrical resistance food browning system, each cooking operation having a plurality of energization intervals of said microwave energy generating system and a plurality of effective browning intervals during which said electrical resistance food browning system is energized, and each effective browning interval being at least approximately thirty seconds in duration.

4. A cooking oven according to claim 3, wherein said food browning system comprises at least one sheathed electrical resistance heating unit.

5. A cooking oven according to claim 4, wherein said sheathed electrical resistance heating element has a diameter within the approximate range of 0.22 to 0.27 inches.

6. A cooking oven according to claim 4, wherein said sheathed electrical resistance heating element is of serpentine configuration and positioned generally adjacent and parallel to, but spaced from, the top wall of said cooking cavity.

7. A cooking oven according to claim 6, wherein the top wall of said cooking cavity has a surface which reflects infrared energy.

8. A cooking oven according to claim 3, which is adapted for operation from a standard 115 volt, 15 amp household branch circuit.

9. A method of operating a microwave oven from an electrical power source of limited capability, the microwave oven being of the type including a cooking cavity, an electrical resistance food browning system having at least one sheathed electrical resistance heating unit of relatively high thermal mass with a resultant heat up rate within the approximate range of 13° F./second to 26° F./second when drawing substantially all of the power available from the electric power source positioned within the cavity so as to brown by radiant heat energy the surface of food being cooked within the cavity, and a microwave energy generating system, the total power required by the food browning system and the microwave energy generating system together being in excess of the power available from the source, which method comprises:

establishing the overall time duration of a cooking operation;

alternately energizing each of the electrical resistance food browning system and the microwave energy generating system for a plurality of energization intervals during the cooking operation, with each energization interval of the food browning system having at least a minimum duration selected to enable the food browning system to reach an effective temperature for efficient browning of the surface of the food by infrared radiant energy and each energization interval of the food browning system being at least approximately thirty seconds.

* * * * *